US007549534B1

(12) United States Patent
Parpart

(10) Patent No.: US 7,549,534 B1
(45) Date of Patent: Jun. 23, 2009

(54) SYSTEM AND METHOD FOR CADDYING A WEDGE AND PUTTER TO A GOLF GREEN

(76) Inventor: Brian E. Parpart, 9 N. Lakeside Dr., Plainfield, IL (US) 60544

( * ) Notice: Subject to any disclaimer, the term of this patent is extended or adjusted under 35 U.S.C. 154(b) by 601 days.

(21) Appl. No.: 11/039,383

(22) Filed: Jan. 19, 2005

Related U.S. Application Data

(63) Continuation-in-part of application No. 10/402,227, filed on Mar. 27, 2003, now abandoned.

(51) Int. Cl.
*A63B 55/06* (2006.01)

(52) U.S. Cl. ..... 206/315.7; 248/96

(58) Field of Classification Search ..... 206/315.7, 206/315.3, 315.2; 280/DIG. 8; 248/96
See application file for complete search history.

(56) References Cited

U.S. PATENT DOCUMENTS

| | | | | | |
|---|---|---|---|---|---|
| 1,444,357 | A | | 2/1923 | Madison | |
| 1,502,300 | A | * | 7/1924 | Fairchild | 206/315.7 |
| 1,811,296 | A | | 6/1931 | Boden | |
| 1,826,216 | A | | 10/1931 | Johnson | |
| 1,926,184 | A | | 9/1933 | Schwer | |
| 2,751,176 | A | * | 6/1956 | Mowry | 248/96 |
| 2,950,748 | A | * | 8/1960 | Olinghouse | 221/279 |
| 3,164,185 | A | * | 1/1965 | Ingoldt | 294/159 |
| 3,465,993 | A | | 9/1969 | Muehlhausen | |
| 4,172,484 | A | | 10/1979 | Henning | |
| 4,420,024 | A | | 12/1983 | Clayton | |
| 4,645,152 | A | | 2/1987 | Downing | |
| 4,792,152 | A | | 12/1988 | Carolan | |
| 4,834,444 | A | | 5/1989 | Young | |
| 4,865,192 | A | | 9/1989 | Williams | |
| 4,898,352 | A | * | 2/1990 | Hoffman | 248/96 |
| 4,942,962 | A | | 7/1990 | Jordan | |
| 5,080,239 | A | | 1/1992 | Rowland | |
| 5,102,529 | A | | 4/1992 | Hickin | |
| 5,112,068 | A | * | 5/1992 | Liao et al. | 280/30 |
| 5,222,703 | A | | 6/1993 | Ricciardelli | |
| 5,265,894 | A | * | 11/1993 | Dunn | 280/47.26 |
| 5,358,109 | A | * | 10/1994 | Nichols | 206/315.3 |
| 5,390,916 | A | | 2/1995 | Govoni | |
| 5,437,423 | A | * | 8/1995 | Sinclair | 248/96 |
| D365,445 | S | | 12/1995 | Boone | |
| 5,472,084 | A | * | 12/1995 | Aliano, Jr. | 206/315.3 |

(Continued)

*Primary Examiner*—Tri M Mai
(74) *Attorney, Agent, or Firm*—Clifford Kraft

(57) ABSTRACT

A system and method for caddying golf clubs to a green that includes an elongated container for holding at least two golf clubs such as a wedge and putter in two compartments where this container module can fit in, and normally be carried in a golf bag or attached to the outside of a golf bag. The container can optionally have one or more spikes located on the bottom for anchoring the module to the ground when in use, or it can have one or more folding legs. In some embodiments, the spike can be retracted when the system is carried in a golf bag. The foldable leg or legs can be held in a folded position against the container with a magnet. In addition, the container can be equipped with a lift-out strap to facilitate taking it out of the golf bag. The optionally spring-loaded spike can be controlled by a lever or activator located on the surface or top of the container.

5 Claims, 8 Drawing Sheets

U.S. PATENT DOCUMENTS 5,632,496 A 5/1997 Nelson
D384,500 S * 10/1997 Muench ..... D3/259
5,799,967 A * 9/1998 Lin ..... 280/646
5,820,479 A 10/1998 Cline et al.
5,873,471 A 2/1999 Ruggeri
5,918,737 A 7/1999 Kwon
6,007,031 A * 12/1999 Tang ..... 248/96
6,164,425 A 12/2000 Latshaw
6,209,721 B1 * 4/2001 Sharpe et al. ..... 206/315.6
6,330,944 B1 * 12/2001 DeMichele ..... 206/315.3
6,640,970 B1 11/2003 Townsend, Jr.
2004/0026279 A1 * 2/2004 Miller ..... 206/315.2

* cited by examiner

SYSTEM AND METHOD FOR CADDYING A WEDGE AND PUTTER TO A GOLF GREEN

This is a Continuation-In-Part of application Ser. No. 10/402,227 filed Mar. 27, 2003 now abandoned.

BACKGROUND

1. Field of the Invention

The present invention relates to the general field of golf club carriers and more particularly to a wedge and putter carrier.

2. Description of the Prior Art

One of the distractions to golfers is that when they approach a green, they must first use a wedge club and then when on the green a putter. Normally, both the wedge and the putter reside in a golf bag with other clubs in a set. The golfer usually has to take both the wedge and the putter with him or her to the green. The putter is normally laid on the ground while the wedge is used to get onto the green. Then the wedge is laid down and the putter is taken to finish the hole. Laying the clubs on the ground has the disadvantage that they get dirty, can be accidentally stepped on and require the golfer to bend to pick them up. What is needed is a container that can carry both the wedge and the putter to the green that fits normally inside a conventional golf bag. This need is apparent when one considers that clubs may be conventionally laid down up to four times per hole.

Prior art methods have included combination putter containers and wedge holders. In U.S. Pat. No. 5,390,916, Govoni teaches such a combination. Govoni's invention suffers from not keeping the wedge and the putter together in the golf bag and not allowing any place for the two clubs. Since the two clubs are used with equal priority, each should be treated equally by the carrier. Govoni provides a spike at the bottom of a putter carrier to place the assembly in the ground. Many other spikes have been used with golf bags in generally to hold them upright. What is needed though, is a system that keeps a wedge and putter together and provides a spike to keep the combination upright.

SUMMARY OF THE INVENTION

The present invention relates to a system and method for caddying golf clubs to a green that can consist of an elongated container module for holding at least two golf clubs such as a wedge and putter in two compartments where this container module can fit in, and normally be carried in a golf bag. The container can have one or more spikes located on the bottom for anchoring the module to the ground when in use. In some embodiments, the spike can be retracted when the system is carried in a golf bag. The retractable spike can be controlled and activated with one or more springs located in the container module. In addition, the container can be equipped with at least one lift-out strap to facilitate taking it out of the golf bag. The optionally spring-loaded spike can be controlled by a lever or activator located on the surface or top of the container.

To use the system, generally a wedge and putter are stored in the container. The container is then placed in the golf bag along side the other clubs in the set. When a green is approached, the golf bag can be left behind and only the container with the two clubs can be pulled out and caddied near the green. The spike can be extended and the container can be held upright near (but not on) the green. The wedge can be used to get onto the green. It can be replaced in the container and the putter removed for putting on the green. After the hole is made, the putter can be replaced in the container, and the container can be caddied back to the golf cart or the location of the entire golf bag. When the system is in use, it also serves to facilitate location of the clubs and to identify clubs belonging to different golfers.

DESCRIPTION OF THE FIGURES

FIGS. 4 and 5 shows a bottom view of the embodiment of FIG. 1.

It should be understood that the above-mentioned figures are provided solely to enhance the understanding of the present invention. The scope of the present invention is not limited to the drawings.

DETAILED DESCRIPTION

The present invention includes a container that has at least two internal elongated compartments or partial compartments that can hold golf clubs. The container module can be equipped with one or more spikes to hold the container upright. The spikes can be spring-loaded or at least in communication with a one or more springs. The spikes can be controlled (such as extended or retracted) by a lever located anywhere on the container, in particular on the side of the container. The spikes can also be fixed with a moveable cover that can be spring loaded.

Figure 1:
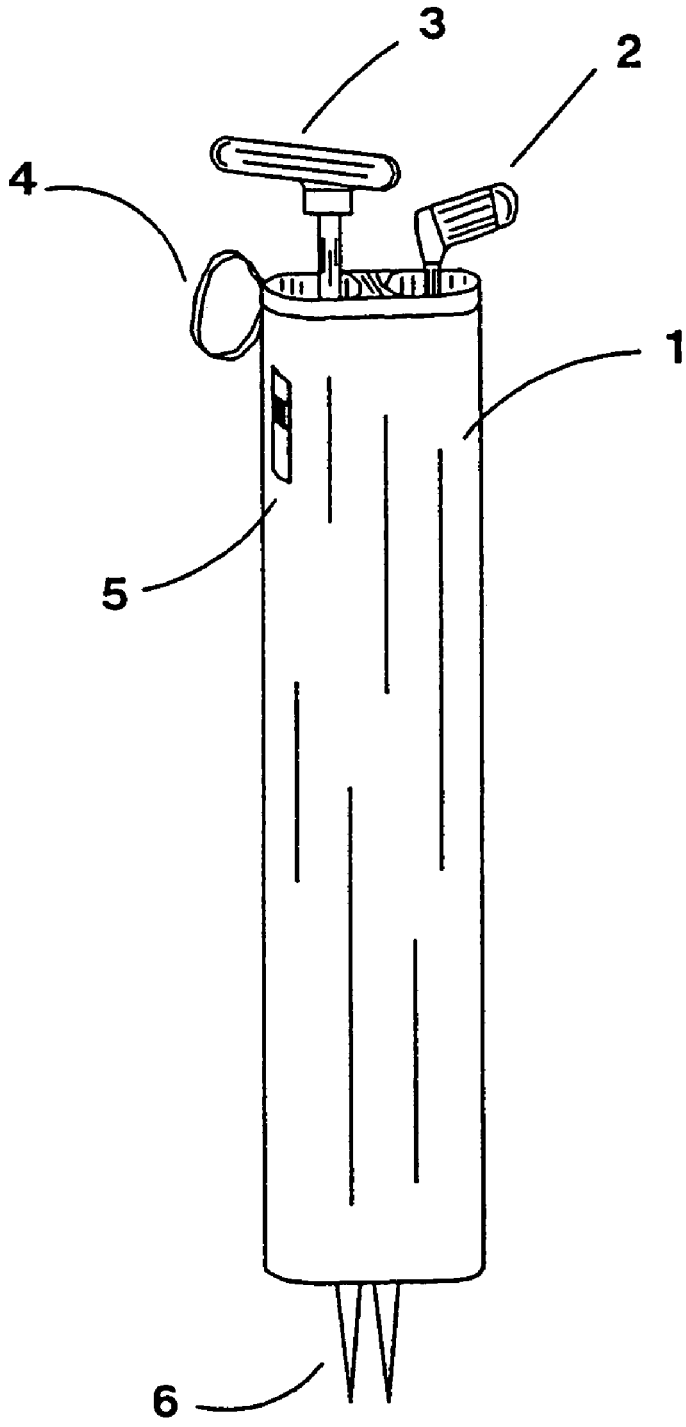
FIG. 1 shows an embodiment of the present invention with an elongated cross section containing two approximately cylindrical containers.
Figure 2:
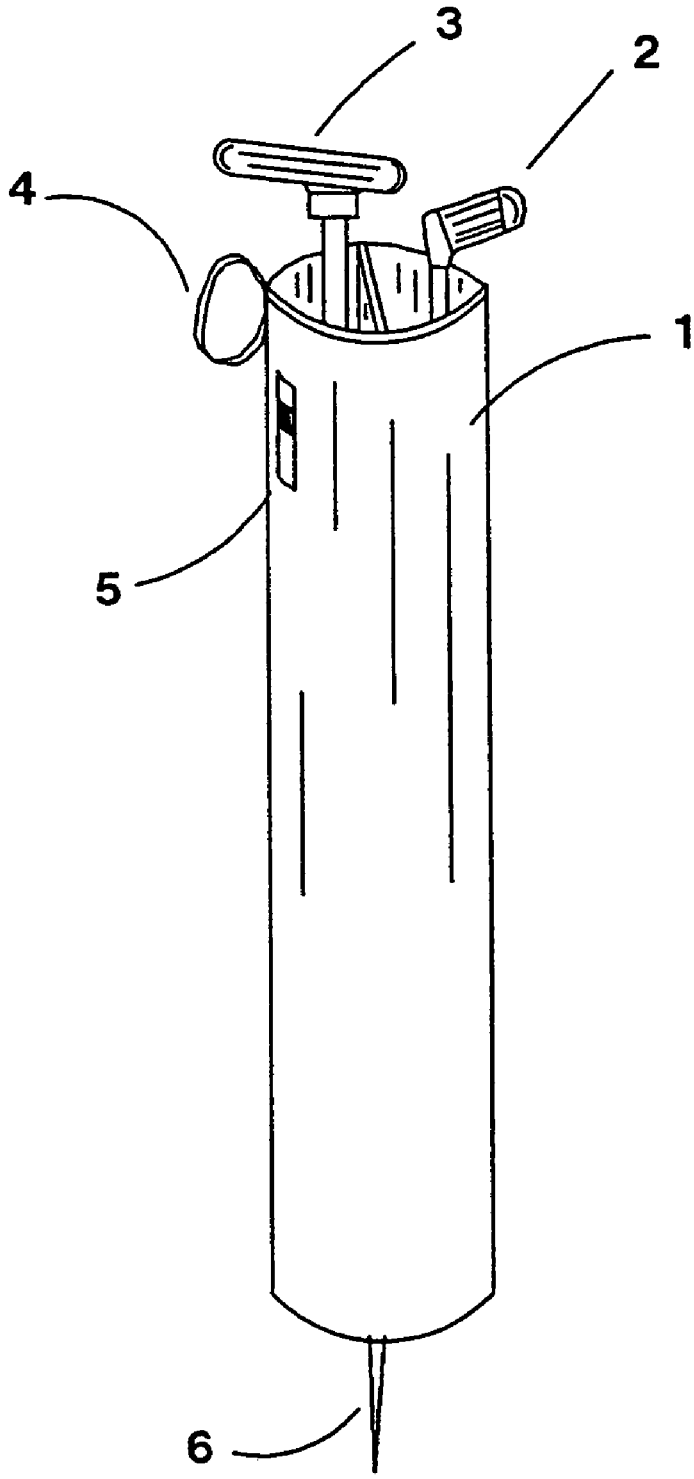
FIG. 2 shows an alternate embodiment of the present invention with two partitioned sections.

As can be seen in FIGS. 1-2, a container 1 can hold two or more golf clubs such as a wedge 2 and a putter 3. One or more spikes 6 can protrude or be extended through the bottom of the container. These spikes 6 can be controlled by a button or switch or lever 5 located on the side or anywhere on the container 1.

Figure 3:
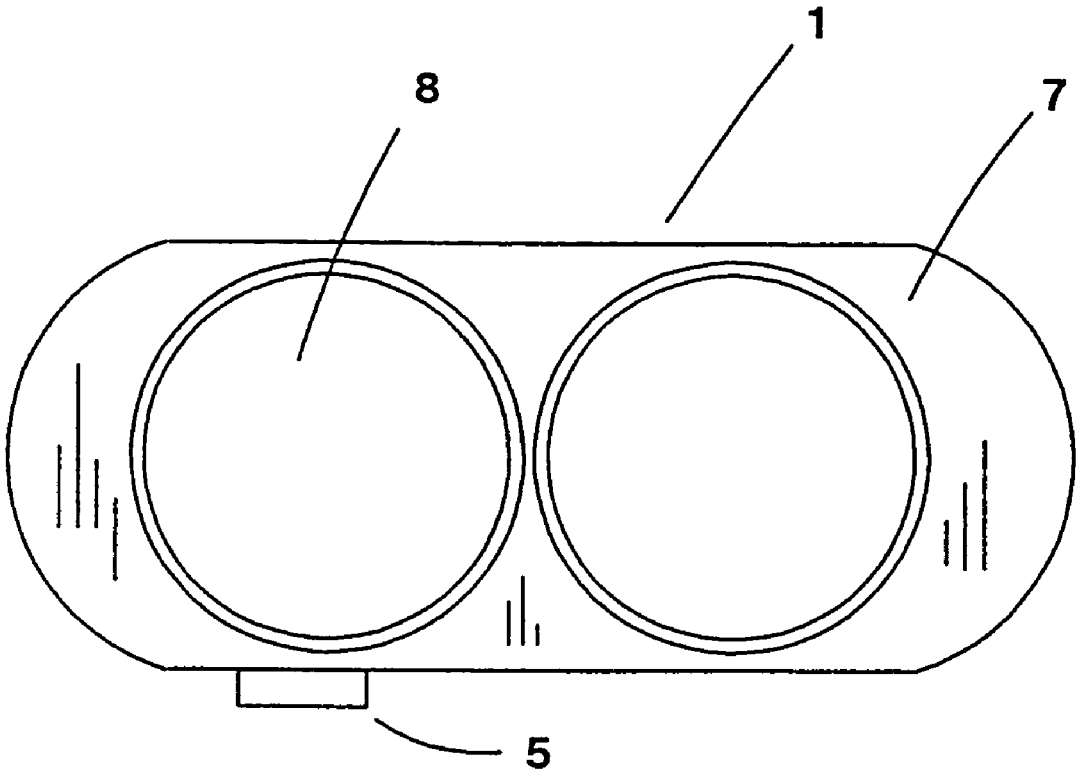
FIGS. 3 and 4 show a view of the embodiment of FIG. 1 looking down from the top.

FIGS. 1 and 2 show two different embodiments of the present invention. FIG. 1 shows a preferred embodiment that can contain two approximately circular compartments for holding the clubs. FIG. 3 shows an embodiment that more resembles the shape of a convention golf bag with a partition. Either embodiment, or any other means of arranging at least two compartments is within the scope of the present invention. The system can be constructed from any durable material. A preferred material is plastic or any rigid fibrous material. It should be noted that the compartments do not need to be totally separated. Any arrangement that holds two golf clubs is within the scope of the present invention.

Figure 4:
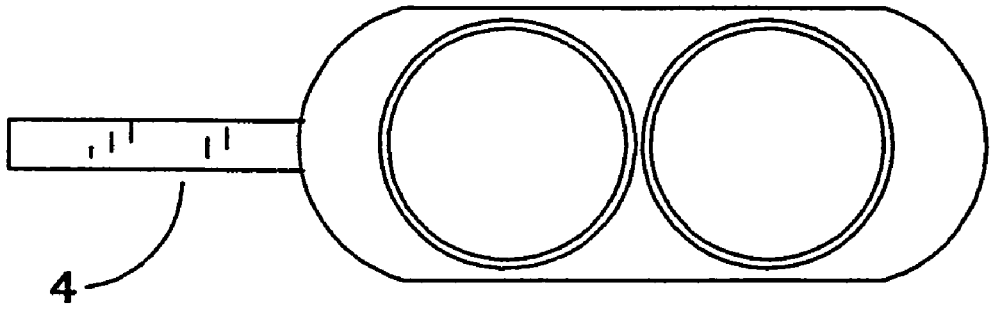

FIGS. 3-4 show top views of the embodiment of FIG. 1. Two approximately cylindrical compartments 8 are located in a container module 1 with a complete or partial partition 7 separating them. It is not necessary to the functioning of the invention that the compartments be cylindrical; any shape is within the scope of the present invention. It is not necessary that the compartments be completely separated. Golf clubs such as a wedge and putter can be inserted vertically into these compartments 8. A handle or lift-out strap 4 can be attached to the side of the compartment 1 to ease lifting the container out of a conventional golf bag. The strap can be attached anywhere on the present invention. This strap can be rigid or flexible and can also be constructed as a rigid hook that can hook over the top of a conventional golf bag, along with a flexible lift-out strap for retrieval. A lever or switch 5 on the side of the container module 1 or elsewhere can be used to extend or retract the spikes.

Figure 5:
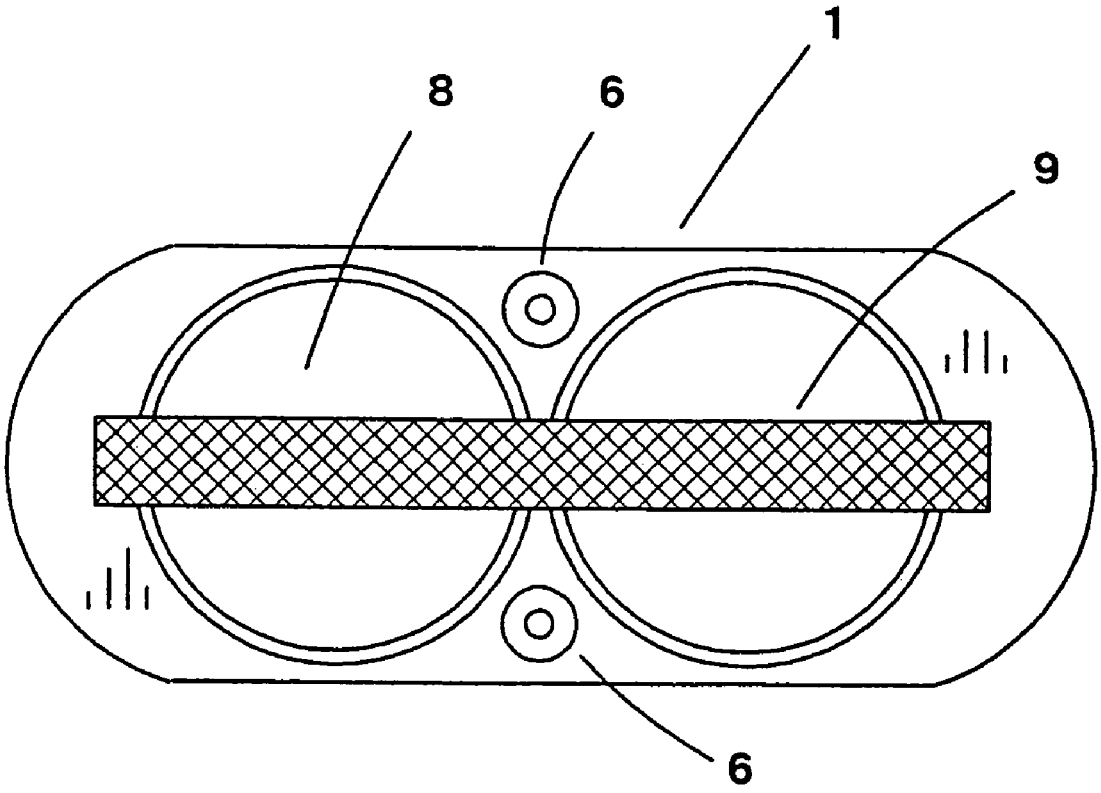

FIG. 5 shows a bottom view of an embodiment of the container module 1. A strap or bottom means 9 can be used to cover the compartments 8 to hold the clubs. Any means that keep the clubs in the device are within the scope of the present invention. This means can be in any position. One or more spikes 6 can be located in the bottom of the compartment 1. Each spike 6 can be fixed or retractable, and can be controlled by any type of internal mechanism. The spikes can be made from any rigid material such as hard plastic or metal. The spikes should be designed to not disturb the course.

Figure 6:
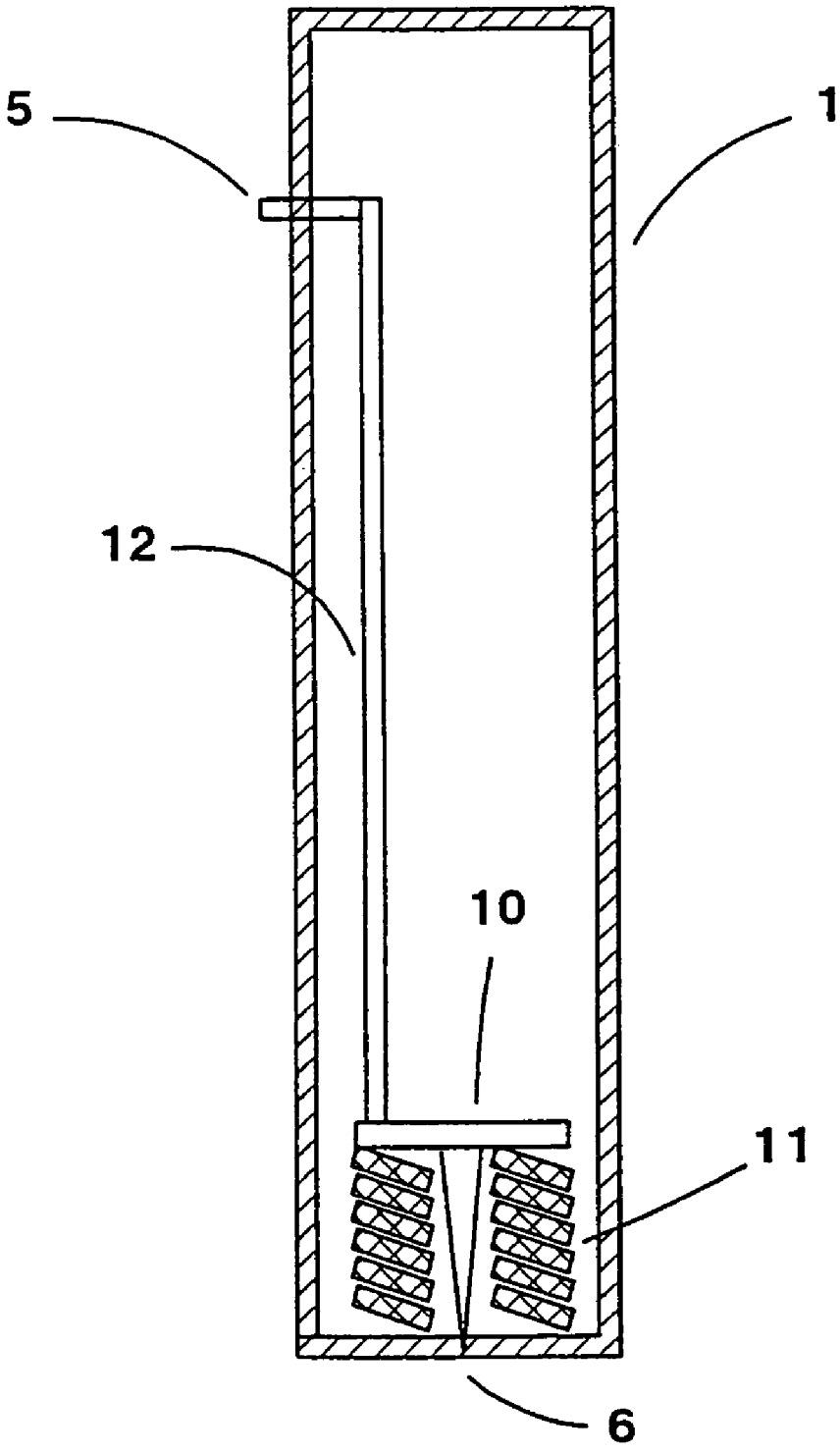
FIG. 6 shows a sample spring mechanism for controlling a spike.

FIG. 6 shows a section view of an embodiment of the present invention. At least one retractable spike 6 is loaded with springs 11 coupled to a plate 10 that moves the spike 6 in and out. It should be remembered that any mechanism that extends or retracts a spike is within the scope of the present invention. It should also be remembered that any arrangement with a fixed spike is also within the scope of the present invention.

Figure 7:
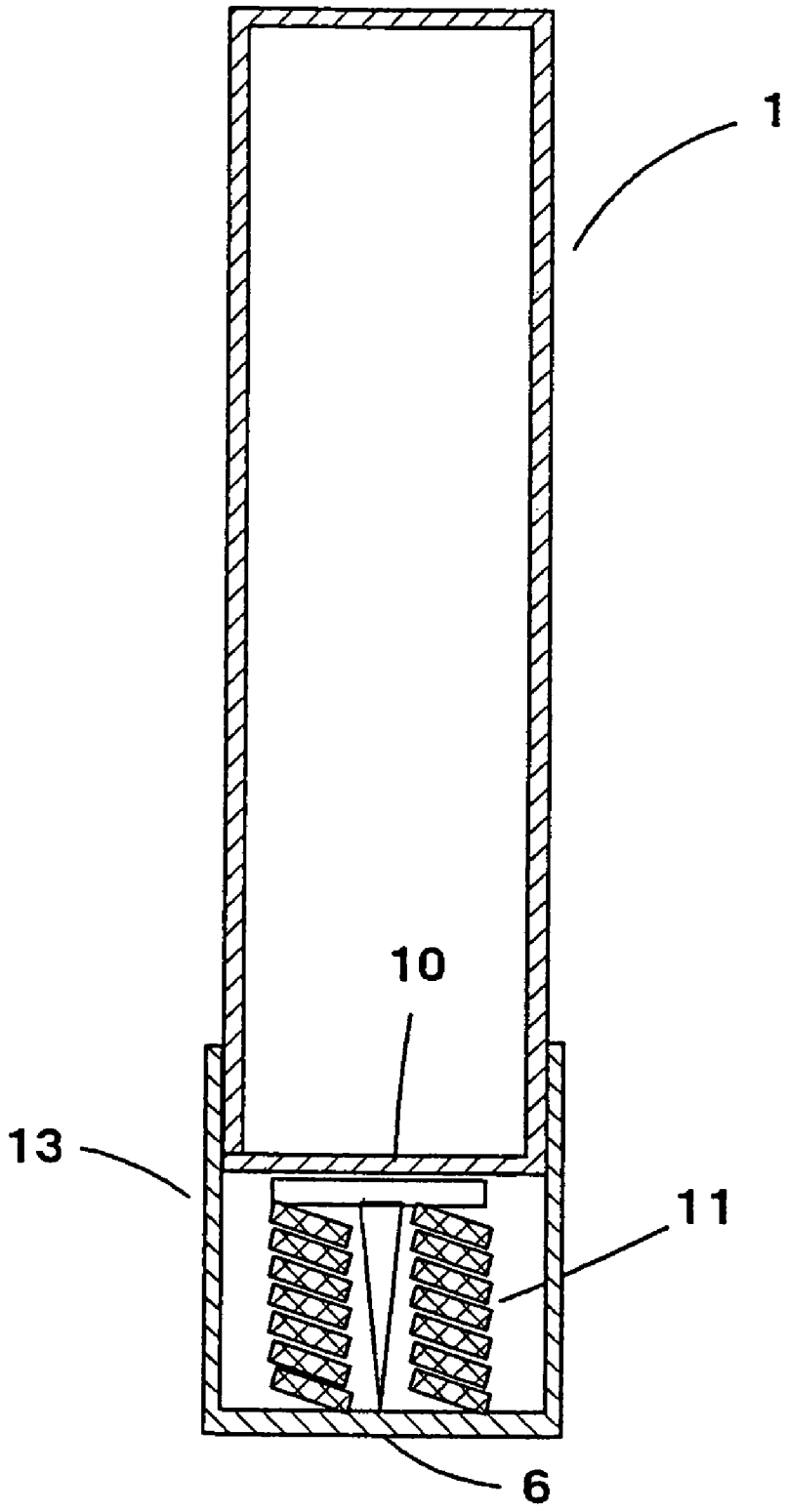
FIG. 7 shows an alternative embodiment with a cover over a fixed spike.

An alternate embodiment of the present invention uses a fixed spike or spikes in the bottom of the device with a fixed or sliding cover around the spike as can be seen in FIG. 7. In this embodiment, the cover 13 can be spring loaded and can slide back to reveal the spike when it is desired to use the spike.

In FIG. 6, a lever or rod mechanism 12 can be attached to a switch or lever or thumb-push 5 that can control the raising or lowering of the spike or spikes 6. Any means of raising or lowering the spike or spikes is within the scope of the present invention. In general, the spike or spikes 6 can be extended with the control 5 when the container module 1 is caddied to a green so that it can be made to stand upright. They can be retracted when it is desired to store the container module in a golf bag or at any time it is not in use.

An alternate embodiment of the present invention can be carried outside the golf bag attached to the golf bag by a strap, VELCRO or by any other means of carrying or attaching it to the outside of a golf bag.

Figure 8:
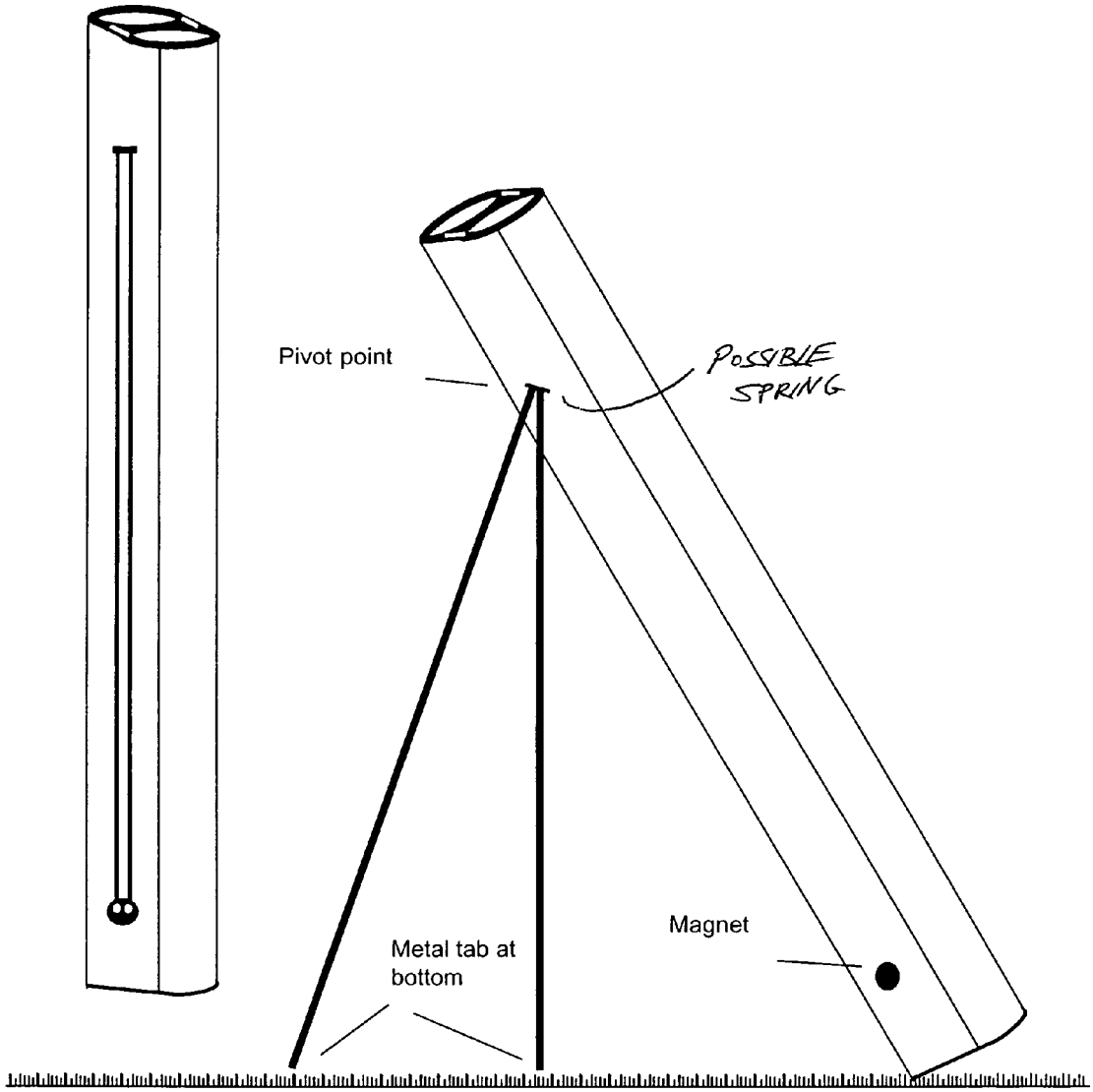
FIG. 8 shows an embodiment of the invention where the container is equipped with foldable legs.

FIG. 8 shows an embodiment of the present invention with a pair of fold-out legs where the container is simply leaned on the legs rather than being put into the ground with a spike. The legs can be of any material and can spread to an acute angle with each other when in the folded-out position as shown in FIG. 8. The legs can be brought together, folded against the side of the container, and held next to the container with a magnet or any other type of fastener. A hinge supplies a pivot point where the legs can pivot outward and optionally pivot to any convenient angle with respect to the long axis of the container. Any folding angle or use angle with respect to the legs and the container and between the legs is within the scope of the present invention.

Figure 9:
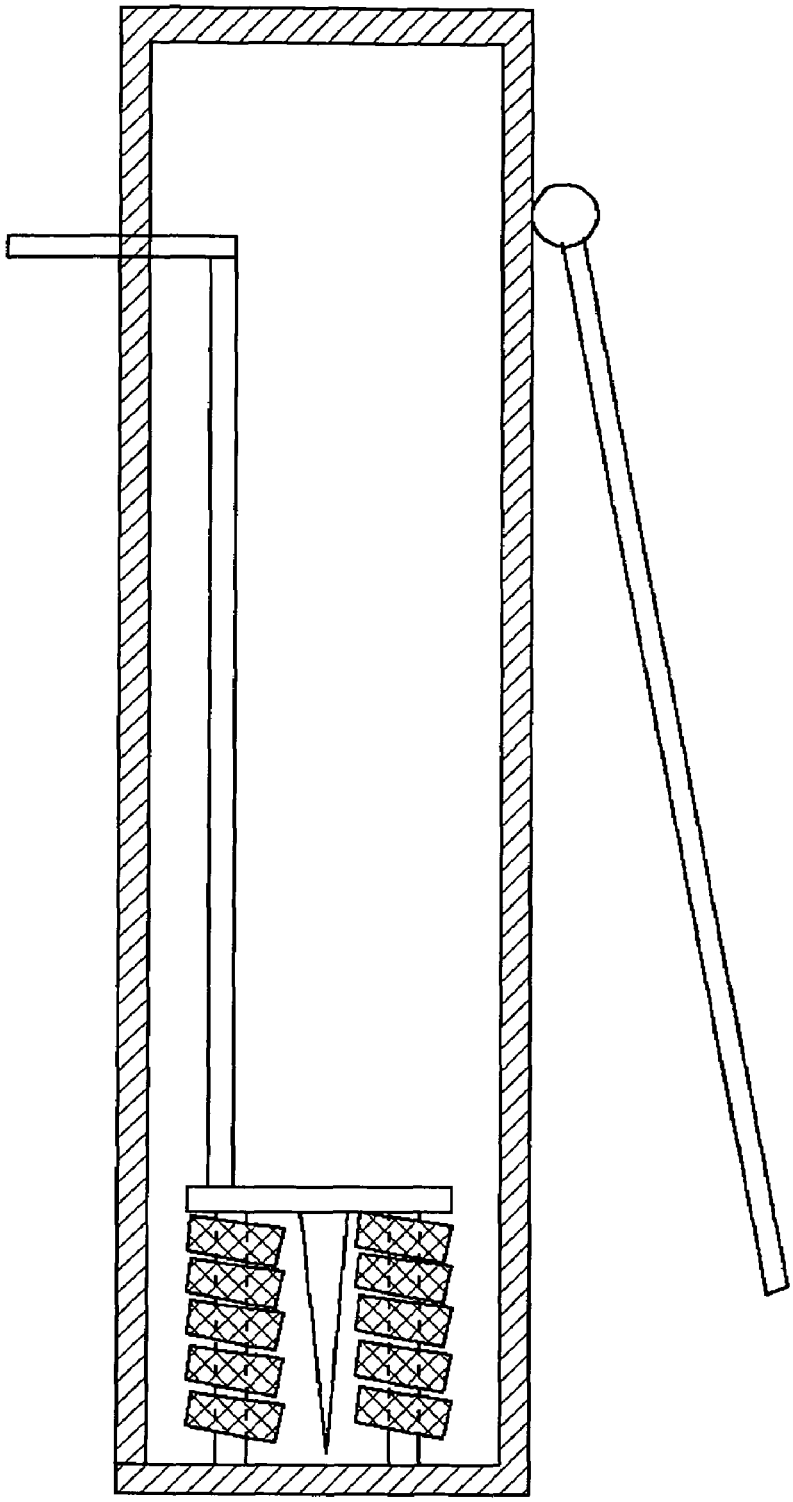
FIG. 9 shows an embodiment of the invention where the container has both legs and a spike.

FIG. 9 shows an embodiment of the present invention that has both legs and a spike. The spike can be controlled by a spring and hand lever.

Various descriptions and figures of the present invention have been presented. It will be apparent to one skilled in the art that numerous changes and variations can be made that are within the spirit and scope of the present invention.

I claim:

1. A system for caddying golf clubs to a green comprising:

an elongated container that can be carried in a golf bag with an upper and lower end and a centerline for holding at least two golf clubs in at least two compartments of approximately circular cross-section, said container having a pair of spikes substantially symmetric about said centerline in said lower end, said spikes being distributed over at least a major portion of said container's width, said spikes being retractable and deployable by a hand-controller lever, said spikes protruding beyond the lower end of said container when deployed, said spikes cooperating with at least one spring in the lower end of said container wherein said spring biases said spikes into a normally retracted position;

a pair of legs attached at a pivot point on one side of said elongated container, said legs having an extended position wherein said legs form an inverted V shape with an apex at said pivot point, and said legs form an acute angle with said container whereby said container leans on said legs;

said legs also having a folded position parallel with each other and along said container running from said pivot point to a base point, said base point containing a magnet holding said legs against said container in said folded position.

2. The system of claim 1 wherein said container module is carried inside said golf bag.

3. The system of claim 1 wherein said golf clubs are a wedge and a putter.

4. The system of claim 1 further comprising a lift-out strap on the upper end of said container module, whereby said strap is used to lift said container module from said golf bag.

5. A system for caddying golf clubs to a green comprising:

an elongated container that can be carried in a golf bag with an upper and lower end and a centerline for holding at least two golf clubs in at least two compartments of approximately circular cross-section, said container having a pair of spikes substantially symmetric about said centerline in said lower end, said spikes being distributed over at least a major portion of said container's width, said spikes being retractable and deployable by a hand-controller lever, said spikes protruding beyond the lower end of said container when deployed, said spikes cooperating with at least one spring in the lower end of said container wherein said spring biases said spikes into a normally retracted position;

a pair of legs attached at a pivot point on one side of said elongated container, said legs having an extended position wherein said legs form an inverted V shape with an apex at said pivot point, and said legs form an acute angle with said container whereby said container leans on said legs;

said legs also having a folded position parallel with each other and along said container running from said pivot point to a base point, said base point containing a magnet means holding said legs against said container in said folded position.

* * * * *

UNITED STATES PATENT AND TRADEMARK OFFICE

CERTIFICATE OF CORRECTION

PATENT NO. : 7,549,534 B1
APPLICATION NO. : 11/039383
DATED : June 23, 2009
INVENTOR(S) : Brian Parpart It is certified that error appears in the above-identified patent and that said Letters Patent is hereby corrected as shown below:

Col. 4, lines 58-62 should read:

said legs also having a folded position parallel with each other and along said container running from said pivot point to a base point, said base point containing ~~a magnet~~ fastening means holding said legs against said container in said folded position.

Signed and Sealed this

Eleventh Day of August, 2009

David J. Kappos

David J. Kappos
*Director of the United States Patent and Trademark Office*